US007296502B1

(12) United States Patent
Hsieh

(10) Patent No.: US 7,296,502 B1
(45) Date of Patent: Nov. 20, 2007

(54) SPANNER WITH A BENDING SECTION

(76) Inventor: Chih-Ching Hsieh, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/512,139

(22) Filed: Aug. 30, 2006

(51) Int. Cl.
*B25B 23/16* (2006.01)

(52) U.S. Cl. ..... 81/177.2; 81/124.6; 81/180.1

(58) Field of Classification Search ..... 81/177.2, 81/177.85, 124.3, 124.6, 438, 176.1, 180.1, 81/185
See application file for complete search history.

(56) References Cited

U.S. PATENT DOCUMENTS 3,832,916 A * 9/1974 Schoeps ..... 81/464
4,344,340 A * 8/1982 Erickson ..... 81/177.2
5,295,423 A * 3/1994 Mikic ..... 81/438
6,427,563 B1 * 8/2002 Zurbuchen et al. ..... 81/177.1
2005/0160882 A1 * 7/2005 Crow ..... 81/177.2

* cited by examiner

*Primary Examiner*—Hadi Shakeri

(57) ABSTRACT

A spanner with a bending section comprises a handle and a driving portion; and a bending connecting portion connected between the handle and the driving portion; the driving portion being installed with an engaging head; a front end of the engaging head having an engaging end; a periphery of the engaging head having a plurality of teeth for engaging the driving portion; a length L of each teeth being longer than a width W of the engaging end. The ratio of L/W is from 2 to 3. Preferably, the ratio is 2.5.

3 Claims, 3 Drawing Sheets

SPANNER WITH A BENDING SECTION

FIELD OF THE INVENTION

The present invention relates to spanners, in particular to a spanner with a bending section, which has a firm structure so that the driving portion of the spanner can be inserted into a deep place for driving a screw easily and conveniently.

BACKGROUND OF THE INVENTION

Form the screws locking the tire rim to a wheel disk, the bending spanner is used to drive the screw. This is because the screws are embedded into recesses. The surface of the tire rim is not flat so that the general used spanner is not suitable for driving the screws to lock a tire.

A bending spanner has a handle and a driving portion. A connecting portion serves to connect the handle and the driving portion. The driving portion has an engaging head. The engaging head has an engaging end for receiving a sleeve. The connecting portion cause that the driving portion is inclined to the handle. The engaging head has teeth for engaging the driving portion. In the prior art, the recess for embedding a screw is too deep, the driving portion can not be sufficiently inserted into the recess for driving the screw. As a result, the nut cannot be tightly engaged.

Moreover, in driving the nut, a react force is applied to the spanner and thus the engaging head will be damaged if it is used for a long time. If the engaging head is too long, it is possible that the engaging head will deform or damages so as to affect the lifetime of the product.

SUMMARY OF THE INVENTION

Accordingly, the primary object of the present invention is to provide a spanner with a bending section, which has a firm structure so that the driving portion of the spanner can be inserted into a deep place for driving a screw easily and conveniently.

To achieve above objects, the present invention provides a spanner with a bending section which comprises a handle and a driving portion; and a bending connecting portion connected between the handle and the driving portion; the driving portion being installed with an engaging head; a front end of the engaging head having an engaging end; a periphery of the engaging head having a plurality of teeth for engaging the driving portion; a length L of each teeth being longer than a width W of the engaging end. The ratio of L/W is from 2 to 3. Preferably, the ratio is 2.5.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
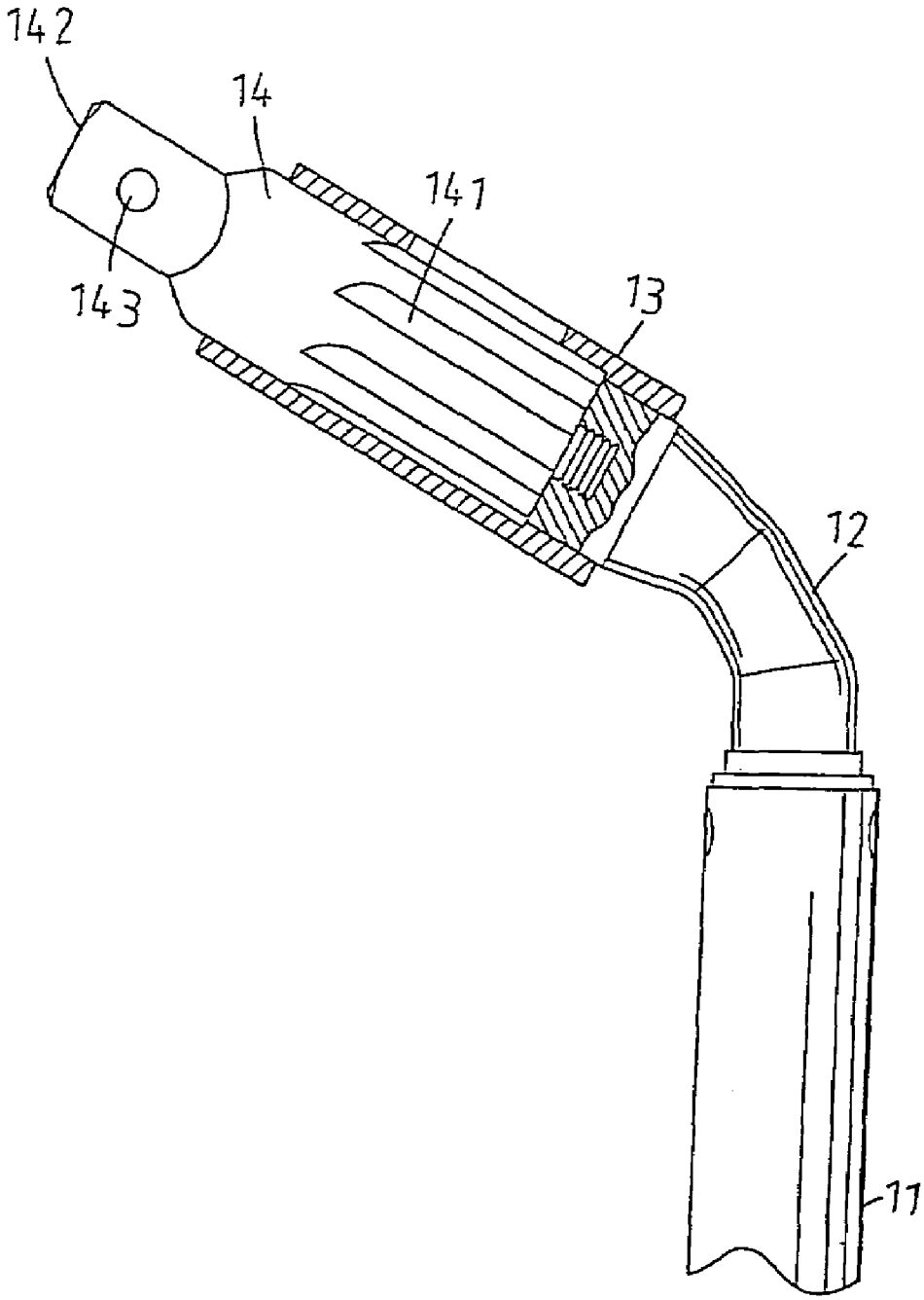
FIG. 1 is a schematic cross sectional view of spanner with a bending section of the present invention.

Referring to FIG. 1, the structure of the present invention is illustrated. The present invention has the following elements.

A spanner body 1 has a handle 11. One end of the handle 11 is connected to one end of a bending connecting portion 12 and another end thereof is connected to a driving portion 13. An axial line of the handle 11 is not parallel to an axial line of the driving portion 13. The driving portion 13 is engaged with an engaging head 14.

The engaging head 14 is a long rod which can be received in the driving portion 13. A plurality of buckling teeth 141 are axially formed on the engaging head 14 for embedding into the driving portion 13. A front end of the engaging head 14 has an engaging end 142 which is a rectangular block. An elastic buckle 143 is installed on the engaging end 142 for positioning a sleeve. A bending angle connected between the handle 11 and the driving portion 13 is an obtuse angle. A threaded post protruded from an end portion of the engaging head 14 for screwing to the handle 11; and the teeth 141 of the engaging end 14 is at an end near the handle 11 after assembling the engaging head 14 of the handle. An elastic buckle 143 is installed on the engaging end 142 for positioning a sleeve; and the driving portion 13 encloses the engaging head 14. A front end of the engaging head 14 has a tapered portion for connecting the engaging end 142 and a width of the engaging end 142 is smaller than a width of the engaging head 14.

Figure 2:
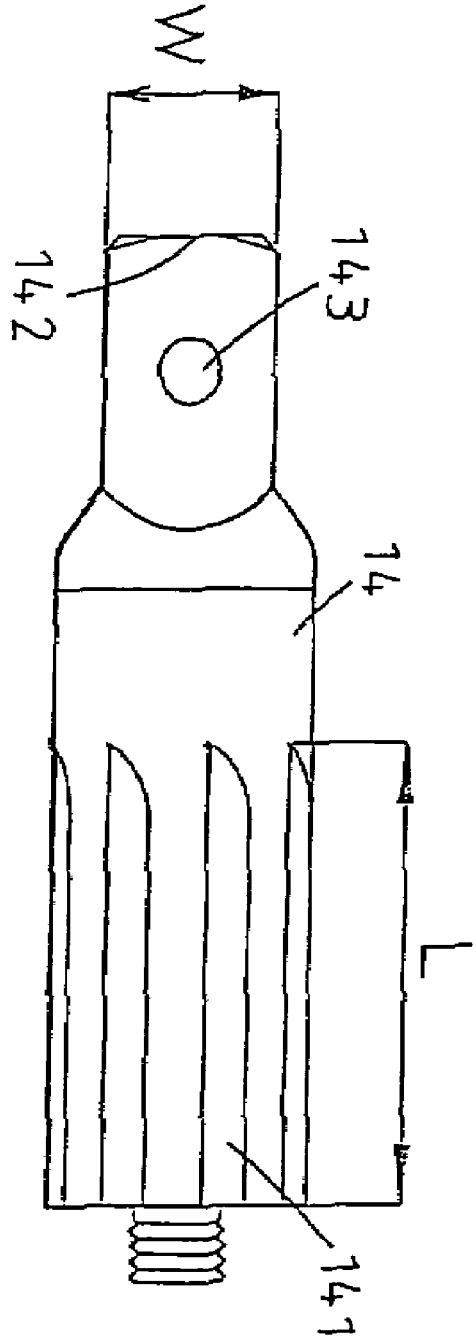
FIG. 2 is a schematic view showing the ratio of the teeth and the engaging end of the present invention.

Referring to FIG. 2, a length of a tooth 141 of the engaging head 14 is L. A length of a side of the rectangular engaging end 142 is W. Preferably, the ratio of L/W is from 2 to 3 so as to provide a firm structure, especially in use. A more preferably structure, the ratio of L/W is 2.5.

In the present invention, the length of the teeth 141 of the engaging end 142 is related to the structure of the engaging end 142. The larger the engaging end 142, the greater the nut to be driven. Thus a great driving force is necessary. To increase the length L of the teeth 141, the engaging head 14 will be firm secured to the driving portion 13. The above ratio of engaging head 14 and teeth 141, the driving portion 13 has a firm structure.

Figure 3:
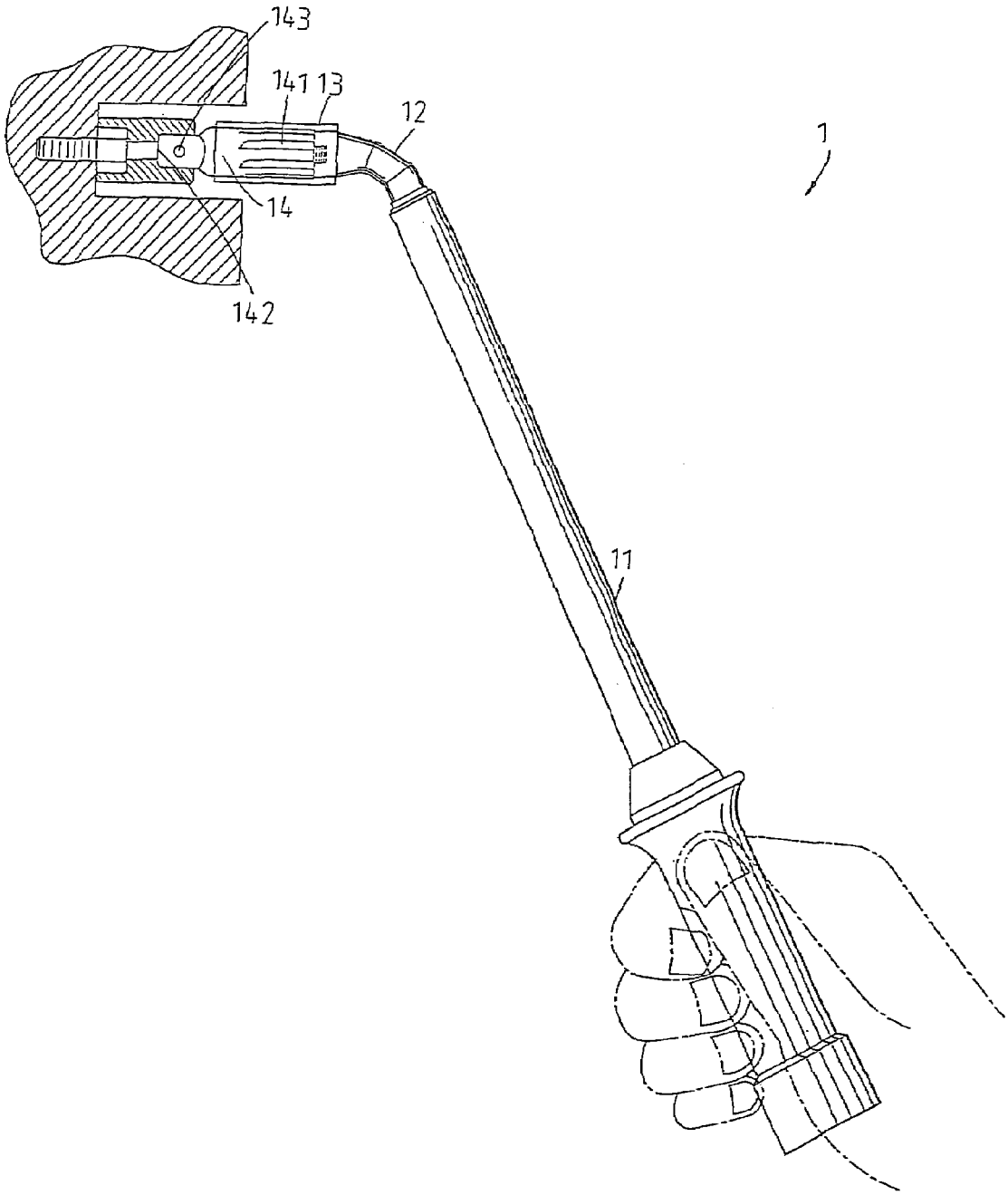
FIG. 3 is a schematic view showing the use of the present invention.

Referring to FIG. 3, the driving portion 13 with the engaging head 14 having a set ratio in the structure provides a strong force to screw a nut. Thus the driving portion 13 will not deform due to the lengths of the engaging head 14 and the teeth 141. Furthermore, the engaging head 14 can be inserted into a deep place due to a proper length thereof.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A spanner with a bending section comprising a handle and a driving portion; and a bending connecting portion connected between the handle and the driving portion; the driving portion being installed with an engaging head; a front end of the engaging head having an engaging end; a periphery of the engaging head distal from the engaging end having a plurality of teeth for engaging the driving portion; a length L of each teeth being longer than a width W of the engaging end; and wherein a bending angle connected between the handle and the driving portion is an obtuse angle;

wherein an elastic buckle is installed on the engaging end for positioning a sleeve;

wherein the driving portion encloses the engaging head;

wherein a front end of the engaging head has a tapered portion for connecting the engaging end and a width of the engaging end is smaller than a width of the engaging head; and wherein a threaded post is protruded from an end portion of the engaging head for screwing to the handle; the teeth of the engaging head are at an end near the handle after assembling the engaging head of the handle; and the teeth of the engaging head are axially formed and embedded into the driving portion.

2. The spanner with a bending section as claimed in claim 1, wherein the ratio of L/W is from 2 to 3.

3. The spanner with a bending section as claimed in claim 1, wherein the ratio of L/W is 2.5.

* * * * *